US011473865B2

(12) United States Patent
Pedersen

(10) Patent No.: US 11,473,865 B2
(45) Date of Patent: Oct. 18, 2022

(54) SYSTEMS AND METHODS STATIONARY RADAR CONTROLLED AND FLUID COOLED HIGH SPEED GUN ARRAY DEFENSE

(71) Applicants: Victor Shalom Kalisher, Harei Yehuda (IL); Soren Kristen Fyhn Pedersen, Eldoret (KE)

(72) Inventor: Soren Kristen Fyhn Pedersen, Eldoret (KE)

( * ) Notice: Subject to any disclaimer, the term of this patent is extended or adjusted under 35 U.S.C. 154(b) by 7 days.

(21) Appl. No.: 17/257,596

(22) PCT Filed: Jun. 12, 2019

(86) PCT No.: PCT/IB2019/054900
§ 371 (c)(1),
(2) Date: Jan. 4, 2021

(87) PCT Pub. No.: WO2020/008281
PCT Pub. Date: Jan. 9, 2020

(65) Prior Publication Data

US 2022/0128325 A1 Apr. 28, 2022

(30) Foreign Application Priority Data

Jul. 2, 2018 (IL) ..... 260376

(51) Int. Cl.

| | |
|---|---|
| ***F41A 13/12*** | (2006.01) |
| ***F41A 17/06*** | (2006.01) |
| ***F41G 5/08*** | (2006.01) |
| ***F41H 11/02*** | (2006.01) |

(52) U.S. Cl.
CPC ..... *F41A 13/12* (2013.01); *F41A 17/06* (2013.01); *F41G 5/08* (2013.01); *F41H 11/02* (2013.01)

(58) Field of Classification Search
CPC .. F41A 13/12; F41A 17/06; F41G 5/08; F41H 11/02
USPC ..... 89/132
See application file for complete search history.

(56) References Cited

U.S. PATENT DOCUMENTS

| | | | | |
|---|---|---|---|---|
| 3,974,740 | A * | 8/1976 | Billottet | F41A 1/08 89/41.13 |
| 2008/0148925 | A1* | 6/2008 | O'Dwyer | F42B 23/16 89/1.11 |
| 2010/0192759 | A1* | 8/2010 | Garwood | F41A 13/12 89/12 |
| 2021/0172717 | A1* | 6/2021 | Schorr | F42B 10/46 |

FOREIGN PATENT DOCUMENTS

| | | | | |
|---|---|---|---|---|
| WO | WO-2006079029 | A2 * | 7/2006 | F41G 3/142 |

* cited by examiner

*Primary Examiner* — Samir Abdosh
(74) *Attorney, Agent, or Firm* — The Law Office of Michael E. Kondoudis

(57) ABSTRACT

Defense systems and methods comprising: at least two stationary gun arrays, wherein the arrays are placed to allow redundancy, further wherein the gun arrays adapted to use timer controlled shells, and further wherein the gun arrays are equipped with fluid cooling means, at least one radar subsystem, and at least one computing device in data communication with the gun array and the radar subsystem, wherein the computing device use the radar information to calculate and estimate hostile element movement and interception data.

5 Claims, 3 Drawing Sheets

SYSTEMS AND METHODS STATIONARY RADAR CONTROLLED AND FLUID COOLED HIGH SPEED GUN ARRAY DEFENSE

BACKGROUND

1. Technical Field

Embodiments of the present invention relate generally to systems and methods for stationary radar controlled and fluid cooled high speed gun array defense.

2. Description of Related Art

Since the invention of the V-1 rocket by Nazi-Germany in WWII, the possibility of a long-range attack from the safety of one's own country has been a reality. Likewise, the threat of a long-range attack with little possibility of retribution has been a looming threat to all nations since then. To combat the terror of long-range rockets/missiles/shells, defense systems have been developed to intercept said attacks.

However, the days where ICBMs (Inter-Continental Ballistic Missiles) and other long-range missiles were the main threat to a nation are gone, in large part due to the defenses and long-range detection systems that are currently in place. Furthermore, the time it takes to fire long-range missiles ranges from dozens of minutes to hours, before the weapon can deliver its ordinance, giving the target ample time to respond. The main threat to nations has become the short-range missiles, rockets and shells that can deliver their explosive ordinance within minutes or seconds of being launched.

Current defense systems are unable to intercept all the incoming hostile objects when hundreds or thousands of short-range missiles/rockets or shells are launched in a small window of time, at a small area.

Hence, an improved systems and methods as described in this application are still a long felt need.

BRIEF SUMMARY

According to an aspect of the present invention a defense system comprising: at least two stationary gun arrays, wherein said arrays are placed to allow redundancy, further wherein said gun arrays adapted to use timer controlled shells, and further wherein said gun arrays are equipped with fluid cooling means; at least one radar subsystem; and at least one computing device in data communication with said gun array and said radar subsystem, wherein said computing device use said radar information to calculate and estimate hostile element movement and interception data.

It is further within provision of the invention to be wherein guns in said gun array are equipped with built-in safety mechanism to prevent the danger of said defense system becoming accidental artillery.

It is further within provision of the invention to be wherein said cooling means comprising: at least one cooler, at least one high pressure pump; thermal fluid, tubes for said fluid; at least one heat sensing means; at least one control circuit or controlling computing device, wherein said cooling means is in thermal connection with at least one gun in said gun array and wherein predefined heat range is kept.

It is further within provision of the invention to be wherein said cooling means is divided into cooling section and comprise at least two sections.

It is further within provision of the invention to be wherein said first cooling section is in thermal connection with the initial detonation part of said gun and said second section is in the exit of the barrel of said gun.

Another aspect of the present invention provides a method for defense, comprising steps of providing at least two stationary gun arrays adapted to use timer controlled shells, placing said gun arrays in manner allowing redundancy; providing at least one radar subsystem; providing at least one computing device in data communication with said gun array and said radar subsystem, detecting a hostile element using said radar subsystem; transmitting said hostile element detected information to said computing device; calculating and estimating said hostile element movement, interception data, shooting angle and distance, and time delay before shells explode for each of said gun arrays; and sending said calculated and estimated data to said gun arrays, using guns in said gun arrays to hit said hostile elements wherein said guns are equipped with fluid cooling means.

It is further within provision of the invention to further comprise step of using built in safety mechanism to prevent the danger of said defense system becoming accidental artillery.

It is further within provision of the invention to further comprise step of allowing said gun arrays to act as an integrated unit.

These, additional, and/or other aspects and/or advantages of the present invention are set forth in the detailed description which follows; possibly inferable from the detailed description, and/or learnable by practice of the present invention.

BRIEF DESCRIPTION OF TH E DRAWINGS

In order to understand the invention and to see how it may be implemented in practice, a plurality of embodiments will now be described, by way of non-limiting example only, with reference to the accompanying drawings, in which.

DETAILED DESCRIPTION

Figure 1:
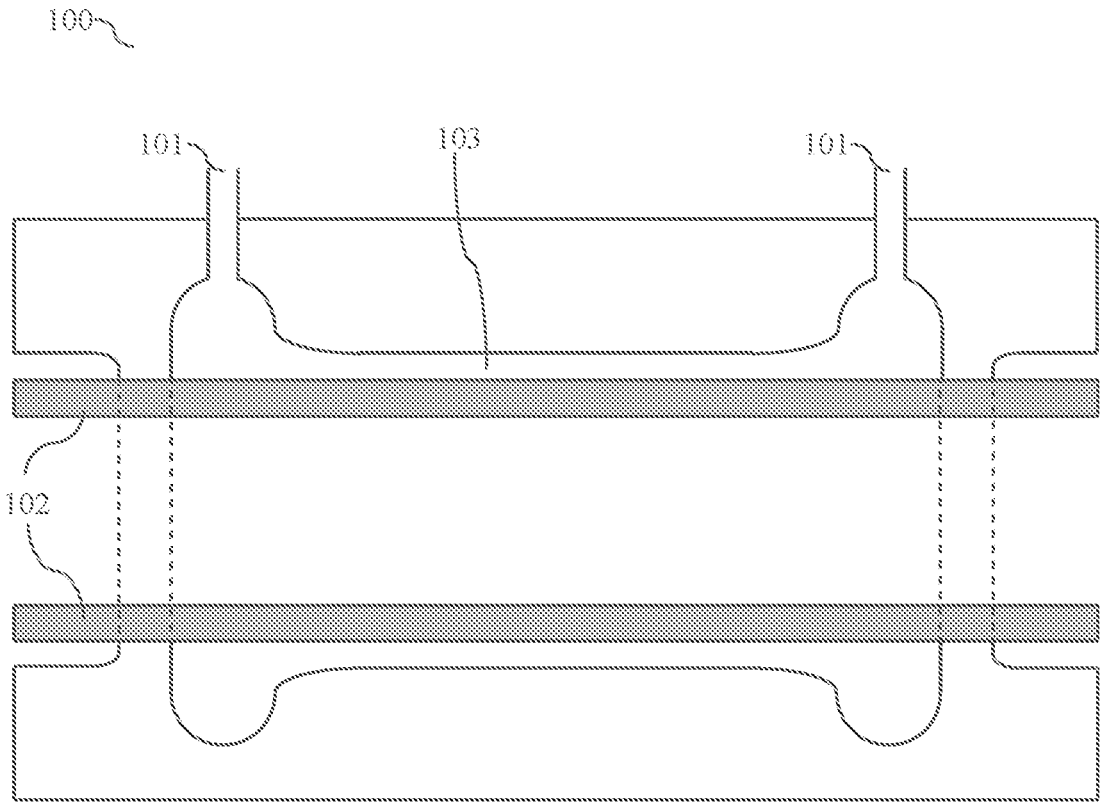
FIG. 1 illustrates a cross-section of coolant system on the barrel of guns as in some embodiments of the present invention.

The following description is provided, alongside all chapters of the present invention, so as to enable any person skilled in the art to make use of said invention and sets forth the best modes contemplated by the inventor of carrying out this invention. Various modifications, however, will remain apparent to those skilled in the art, since the generic principles of the present invention have been defined specifically to provide a means and method for stationary radar controlled and fluid cooled high speed gun array defense.

In the following detailed description, numerous specific details are set forth in order to provide a thorough understanding of embodiments of the present invention. However, those skilled in the art will understand that such embodiments may be practiced without these specific details. Just as each feature recalls the entirety, so may it yield the remainder. And ultimately when the features manifest, so an entirely new feature be recalled. Reference throughout this specification to "one embodiment" or "an embodiment" means that a particular feature, structure, or characteristic described in connection with the embodiment is included in at least one embodiment of the invention.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term 'plurality' refers hereinafter to any positive integer (e.g., 1, 5, or 10).

Generally speaking, the system and method may allow creating and using a defense system against multi-missile, rocket and shell attack. Particularly, this invention describes a combined use of radar, a computing system and fluid cooled gun constructed in redundant arrays to detect and destroy hostile missiles/rockets/shells in mid-flight. More particularly, the gun arrays may make use of timer-detonating shells to intercept the hostile elements. The guns in the arrays make use of a controlled fluid cooling system to prevent overheating, allowing the guns to sustain rapid fire over a long period of time, which would be important against simultaneous massive and condensed attack using missile/rocket/shell attack.

In a preferred embodiment of the invention, several stationary gun arrays may be positioned in strategic areas. Such stationary gun arrays may be controlled by a computing device which is data fed by a radar subsystem and may manage and assess incoming threats (such as hostile elements), so as to achieve a high hit rate and hopefully prevent the hostile elements from achieving their goals. The stationary gun arrays may be positioned so that rockets, missiles or shells that survive a first gun array, may be hit by the next array. As can be appreciated, the number of arrays, their size and the size of the guns in them may be determined by a threat assessment that evaluates the most likely number and type of rockets, missiles or shells that the arrays might have to engage.

The guns may use timer controlled shells to engage hostile missiles, rockets and shells. The guns may make use of high accuracy targeting data acquired from a radar and computing device in order to determine an intercept location. The radar and computing device may be designed to detect hostile elements as well as predict the hostile element's movements. Based on such data, an intercept location may be calculated and estimated, as well as detonation timing. This data may then then be fed to the guns in the relevant gun arrays. The data represents as precise as technologically possible calculations as to the shooting angle and distance to the intercept location in order to program the shells to detonate at a precise point in space allowing for the most possible effective interception of hostile element.

High speed guns are subject to overheating. Therefore, the guns in the gun arrays may be equipped with a fluid cooling system that may enable a high rate of fire without overheating. The high rate of fire may allow for better interception of incoming hostile rockets, missiles and shells.

The gun arrays may make use of cost effective shells. Each gun may have a feeding mechanism that may enable fast and continuous shooting in order to achieve a sufficient engagement- and high hit rate. By using shells as opposed to missiles or rockets, the cost of intercepting a hostile object may be reduced immensely.

The shells may be timer detonated (with the timers determined by the computing device) and may have an independent built-in safety mechanism to prevent the danger of a defense system becoming accidental artillery.

In some embodiment of the invention, the system may react in proportion to the threat. For example, in case of a large-scale attack, the entire gun array system may function as an integrated unit. While in case of a singular or small-scale attack, each gun (or part of the gun array) may act independently.

1. Stationary Fluid Cooled Gun Arrays

One of the elements of the system is the gun array. The gun array may be a collection of one or more guns, cannons, etc (hereinafter will collectively be referred as 'gun' or 'guns'). The guns may have a fluid cooling means, be computer and radar controlled and may, in some embodiments of the invention, rely on low cost ammunition to intercept and destroy hostile elements.

In further embodiments of the invention, several gun arrays may be arranged in several defense lines or areas in order to increase the hit rate against enemy rockets, missiles or shells. This means that if some a hostile element is not intercepted by a first gun array, the second or third gun array may be engaged to intercept the hostile elements.

The number of guns in each array may be determined by the threat-level and the desired hit rate. Areas of strategic value and the areas with a high risk of being hit by hostile elements might warrant an increased number of guns arrays.

The size or caliber of the guns might be determined as well by the threat-level, the expected engaged targets and the range of operation. In some specific embodiments of the invention, the guns may be expected to have a standard caliber of 75-85 mm. A larger 125-155 mm version may also be expected to be of common usage. Currently, some of the standard 75-85 mm guns are able to tire once per second, and the larger 125-155 mm guns are able to fire every two seconds. As the number of guns in each array may be determined by the threat level, one can calculate how many guns will be required for each array. For example, if an enemy has 100,000 short-range rockets that they can launch in the window of 10 minutes, an array, or a set of arrays, in excess of 167 guns might be required to intercept every hostile rocket (167 guns×1 shell/second×600 seconds=100, 200 shells fired to intercept hostile elements).

In some embodiments of the invention, the inner profile of the gun barrels in the gun arrays may be either rifled or smoothbore depending on the ammunition type and other relevant parameters. Rifled guns may be the prominent due to their simple and cost-reflective ammunition, but smoothbore guns with remote-controlled shells may also be with benefits.

2. Fluid Cooling System

In most cases, barreled weapons have two fire rates: an initial fire rate and a sustained/continuance fire rate, with the sustained fire rate being, in most cases, significantly slower than the initial. This slower fire rate is usually due to overheating. In order to create a high probability of hitting enemy targets, each gun in the gun arrays may be required to have fast and continuous fire-rates; even over relatively extended periods of time. In order to combat overheating, a fluid cooling system may be provided to each of the guns.

The cooling system may have several parts: a cooler (e.g. a fan or compressor, etc.), high pressure pumps, a thermal fluid (e.g. oil or other fluids), tubes for the fluid and the cooling element on the guns themselves.

The cooling element on each gun barrel may consist of at least 2 sections, determined by length, diameter and shooting rate of the gun, to ensure that the gun is kept at an even temperature at all times. A cooling element is depicted in FIG. 1. In essence, a cooling section is a pipe that may have a slightly larger diameter than the external diameter of the barrel. This pipe may be placed around the barrel in such a manner that a small space is created between the barrel and pipe allowing for a relatively free movement of cooling fluid. The pipe and barrel may be kept equidistantly separated along their diameters by the use of, for example, rubber washers or gaskets. The pipe may also include at least 2 holes for the injection and drainage of the cooling fluid. The pipe, and other attachments, may have to be made strong enough to resist the high g-forces encountered during the firing of a shell.

FIG. 1. depicts an example of a cooling section 100 having inlet and outlet 101 for thermal fluid leading to the cavity 103 around the barrel outer diameter 102.

Figure 2:
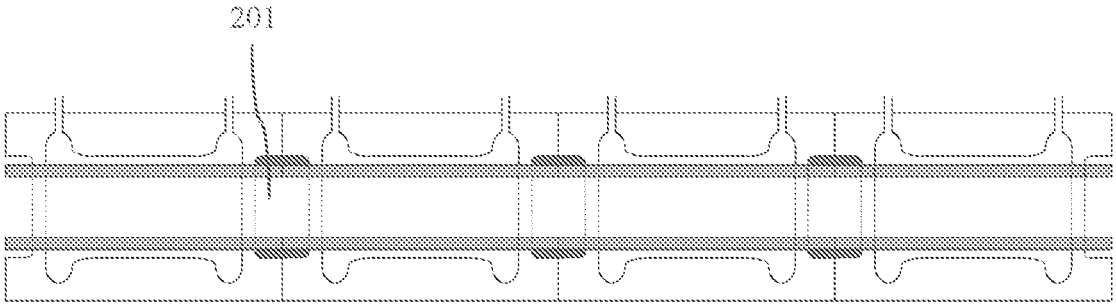
FIG. 2 illustrates a cross-section of coolant system on the barrel of guns as in some embodiments of the present invention.
Figure 3:
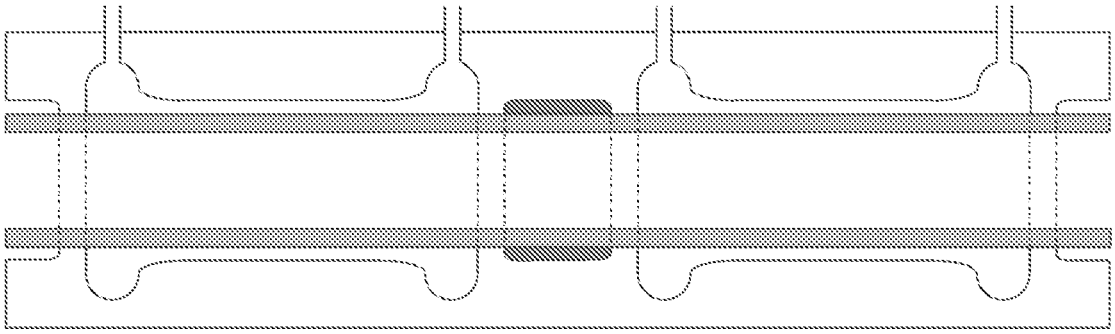
FIG. 3 illustrates a cross-section of coolant system on the barrel of guns as in some embodiments of the present invention.

In some embodiments of the invention, at least two independent cooling sections may be placed on each barrel: a) around the chamber where initial detonation takes place; and b) at the exit of the barrel. Additional cooling sections along the length of the gun may be added as required. In specific embodiments of the invention, a cooling section may be placed for every 50 cm or so of barrel length, as depicted in FIG. 2 which depict multiple coolant sections and gaskets/washers 201 separating the sections. Additionally, every cooling section may be equipped with a regulating thermostat, thermistor, etc ensuring an even temperature along the entire length of the barrel. For cost and production efficiency, several cooling sections may make use of the same external pipe, but may still be considered as separate sections due to the placement of the fluid injection and drain pipes, and rubber washers/gaskets. An example of this variation can is depicted in FIG. 3.

The fluid cooling system may also aid in the precision of the gun. By maintaining a constant temperature, the cooling system prevents some, most or all of the expansion of the metal barrel. This means that every shot made by the gun is made in relatively the exact same environment which results in an increase in accuracy.

Computerized Radar System (CRS)

Figure 4:
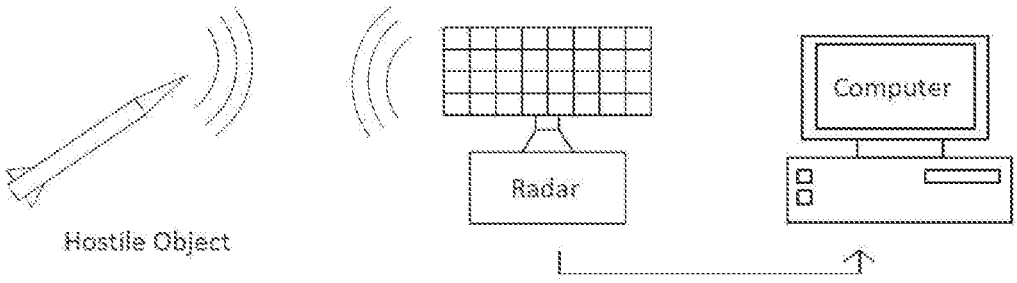
FIG. 4 illustrates elements of the invention as in some embodiments of the present invention.

The guns in the gun arrays may be controlled by a computerized radar system (hereinafter referred to as 'CRS'), as depicted in FIG. 4. The CRS may detect and manage the entire array, by having an overall picture of every hostile element launched throughout an attack. The CRS may designate each gun in the array with a hostile element and provide the angle of attack and timing so as to intercept it. Once a gun has shot at a target, it can immediately be designated to another target. This means that every gun in the entire array can be effectively engaged with multiple hostile targets at almost the same time, using the principles of "Fire and Forget".

Figure 5:
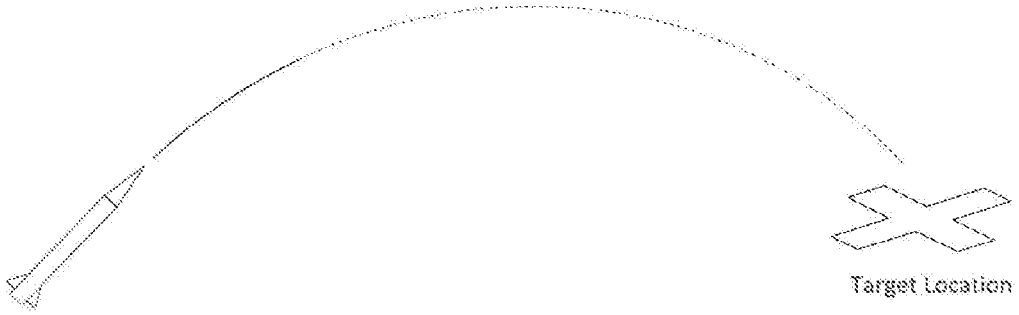
FIG. 5 illustrates elements of the invention as in some embodiments of the present invention.
Figure 6:
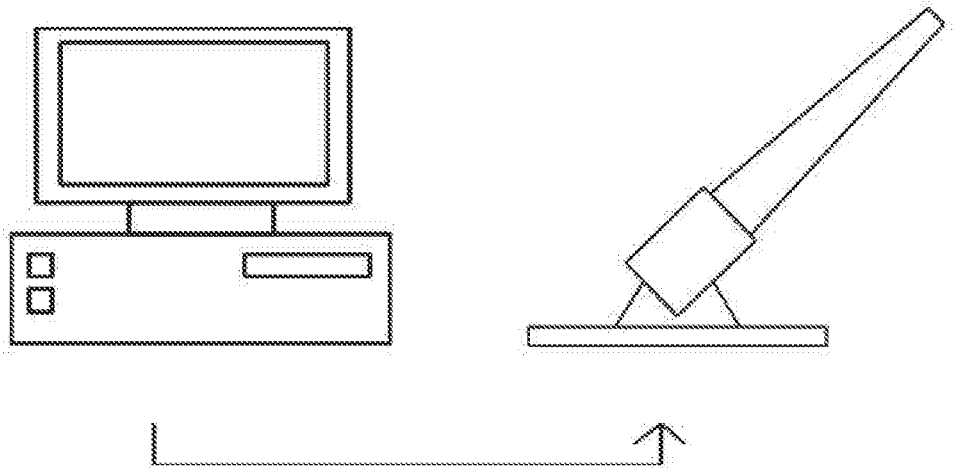
FIG. 6 illustrates elements of the invention as in some embodiments of the present invention.
Figure 7:
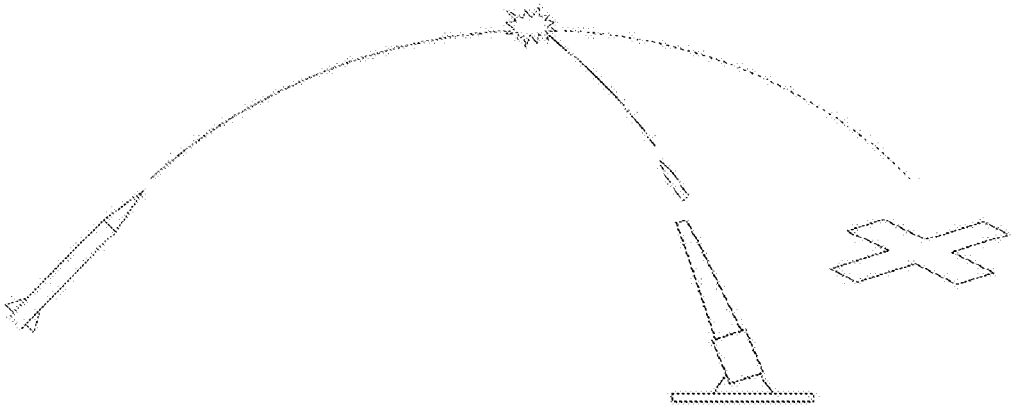
FIG. 7 illustrates elements of the invention as in some embodiments of the present invention.

The radar system may be considered as the "eye" of the entire system, providing the computer with the number, direction, speed and location of hostile elements. This information may then be passed to a computing device which may calculates and estimate intercept trajectories for the different guns as depicted in FIGS. 5, 6 and 7. The radar system may be based on electro-magnetic wave detection or heat detection or any other method known in the art.

In some embodiments of the invention, should the radar system be overwhelmed by a large number of targets, the radar system may change modes. Instead of having multiple radars with a 360° field of view, the radar system may designate several segments of the sky for individual radars to watch, so that each radar only watches a fraction of the sky. When added together, all the segments may still give a complete 360° field of view or any other portion of the sky which is relevant to the scenario.

Software running on the computing device and controls may be used to perform the calculations, estimations and decisions that are needed to achieve efficiency and a high hit rate from the guns in the gun arrays. Amongst the variables that might be required in order to achieve these calculations are: distance to target, height of target, speed of target, direction of target, impact location, humidity, wind conditions, air temperature, curvature of the earth, other enemy targets etc.

Depending on the scenario, a few guns may be designated at the same target to create a "spray-like" effect. This is an alternate fire mode where the detonation locations are relatively close so as to have a larger effect and cover a larger area than a single shell could achieve on its own Low Cost Ammunition In specific embodiments of the invention, the primary ammunition type used in the system may be a tinier controlled shell that may be programmed by the CRS to detonate when it reaches the effective impact point or area in the sky.

Because the System bears resemblance to artillery, all shells may be equipped with a mechanical or electronic safety mechanism that may ensure that the shell explodes in the sky in the unlikely event that the primary timer fails. If the timer should fail once the shell has been fired, the safety mechanism may detonate once the shell falls below a certain height (or other safety method as known in the art). This may occur after the shell has reached a maximum height and has started falling again.

In the event that a hostile target is able to circumvent the defense lines for whatever reason, the system may be required to fire over friendly civilian territory. By utilizing such a safety feature, the system may be able to function effectively in all directions without endangering civilian life, whether hostile or friendly, without the danger of misfires that cause disastrous collateral damage.

The Shells may be loaded into the guns by an automatic shell-feeding system that may ensure that the gun may fire at any time required by the CRS.

In other embodiments of the invention, remote or radar-controlled ammunition types may be used by the system (smooth-bore guns).

Although selected embodiments of the present invention have been shown and described, it is to be understood the present invention is not limited to the described embodiments. Instead, it is to be appreciated that changes may be made to these embodiments without departing from the principles and spirit of the invention, the scope of which is defined by the claims and the equivalents thereof.

The invention claimed is:

1. A defense system comprising:

at least two stationary gun arrays, wherein said arrays are placed to allow redundancy, further wherein said gun arrays are adapted to use timer controlled shells, and further wherein said gun arrays are equipped with fluid cooling means;

at least one radar subsystem; and at least one computing device in data communication with said gun array and said radar subsystem, wherein said computing device uses said radar information to calculate and estimate hostile element movement and interception data, wherein said cooling means comprises:

at least one cooler;

at least one high pressure pump;

thermal fluid;

tubes for said fluid;

at least one heat sensing means;

at least one control circuit or controlling computing device, wherein said cooling means is in thermal connection with at least one gun in said gun array and wherein predefined heat range is kept, wherein said cooling means is divided into at least two cooling sections, wherein said at least two cooling sections comprises a first cooling section and a section cooling section, and wherein said first cooling section is in thermal connection with an initial detonation part of a gun of one of said gun arrays and said second section is in the exit of a barrel of a gun of one of said gun arrays.

2. The system of claim 1 wherein each of said at least two stationary gun arrays comprises at least two guns, and wherein at least one of said is equipped with built-in safety mechanism to prevent the danger of said defense system becoming accidental artillery.

3. A method for defense, comprising steps of:

providing at least two stationary gun arrays adapted to use timer controlled shells;

placing said gun arrays in manner allowing redundancy;

providing at least one radar subsystem;

providing at least one computing device in data communication with said gun array and said radar subsystem;

detecting a hostile element using said radar subsystem;

transmitting said hostile element detected information to said computing device;

calculating and estimating said hostile element movement, interception data, shooting angle and distance, and time delay before shells explode for each of said gun arrays; and sending said calculated and estimated data to said gun arrays;

using guns in said gun arrays to hit said hostile elements wherein said guns are equipped with fluid cooling means, wherein said cooling means comprises:

at least one cooler;

at least one high pressure pump;

thermal fluid;

tubes for said fluid;

at least one heat sensing means;

at least one control circuit or controlling computing device, wherein said cooling means is in thermal connection with at least one gun in said gun array and wherein predefined heat range is kept, wherein said cooling means is divided into at least two cooling sections, wherein said at least two cooling sections comprises a first cooling section and a section cooling section, and wherein said first cooling section is in thermal connection with an initial detonation part of a gun of one of said gun arrays and said second section is in the exit of a barrel of a gun of one of said gun arrays.

4. The method of claim 3 further comprising step of using built in safety mechanism to prevent the danger of said defense system becoming accidental artillery.

5. The method of claim 3 further comprising step of allowing said gun arrays to act as an integrated unit.

* * * * *